United States Patent [19]

van Rossem

[11] 4,278,167

[45] Jul. 14, 1981

[54] PACKAGE FOR RADIOPHARMACEUTICAL COMPOSITIONS

[75] Inventor: Hendrik van Rossem, Sint Maartensburg, Netherlands

[73] Assignee: Byk-Mallinckrodt CIL B.V., Petten, Netherlands

[21] Appl. No.: 37,674

[22] Filed: May 10, 1979

[30] Foreign Application Priority Data

May 11, 1978 [NL] Netherlands ..... 7805066

[51] Int. Cl.[3] ..... B65D 25/54; B65D 25/10; B65D 85/00

[52] U.S. Cl. ..... 206/45.34; 206/459; 206/527; 40/310; 215/12 R

[58] Field of Search ..... 206/45.34, 527, 459; 215/12 R; 250/364; 40/310

[56] References Cited

U.S. PATENT DOCUMENTS

| | | | |
|---|---|---|---|
| 2,664,998 | 1/1954 | Gifford et al. | 206/527 |
| 3,179,243 | 4/1965 | Ashcroft | 206/527 |
| 3,374,911 | 3/1968 | White | 215/12 R |
| 3,404,270 | 10/1968 | Ross | 250/364 |
| 3,621,994 | 11/1971 | Brown | 215/12 R |
| 3,662,706 | 5/1972 | Soini | 40/310 |
| 3,937,961 | 2/1976 | Benvenutti | 215/12 R |

*Primary Examiner*—William T. Dixson, Jr.
*Attorney, Agent, or Firm*—Bernard & Brown

[57] ABSTRACT

A package for radiopharmaceutical compositions is provided, which package consists essentially of a labelled glass vial around which a transparent holder is secured. Preferably, the transparent holder also has a label and is detachably secured to the composition-containing vial.

9 Claims, 2 Drawing Figures

FIG 1
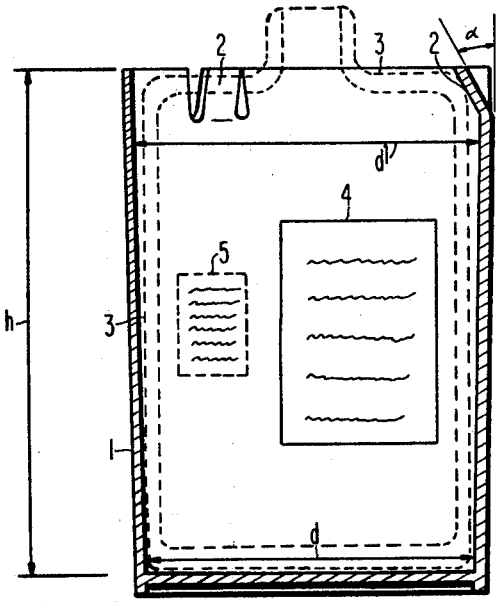
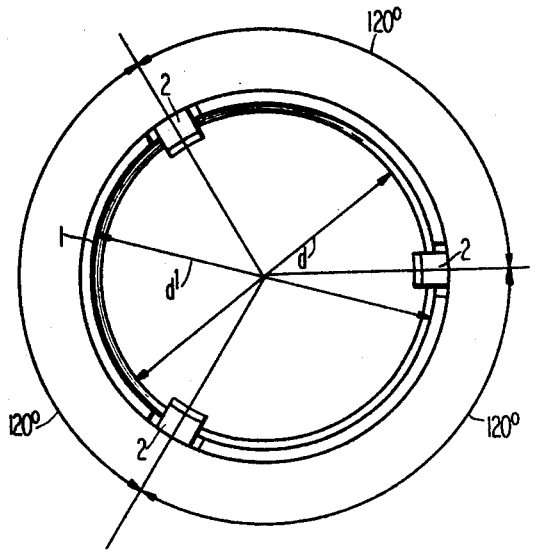
FIG 2

PACKAGE FOR RADIOPHARMACEUTICAL COMPOSITIONS

The invention relates to a package for radiopharmaceutical compositions and to a holder for said package.

Radiopharmaceutical compositions generally are liquid pharmaceutical compositions having a given content of radioactive material. These compositions are used, for example, for diagnostic purposes.

In connection with known radiation dangers, great care must be taken during manufacture of the compositions, during dispensing, in packaging for transit to the user after manufacture, during possible storage of the compositions and also during their use.

It will be obvious that the package contributes to a considerable extent to an optimum protection against radioactive radiation. It is therefore usual to ship and store packages of vials or ampoules containing radiopharmaceutical compositions in a lead pot. The usual package of tinplate and cardboard may then be provided around the lead pot.

In addition, vials or ampoules containing pharmaceutical compositions are usually provided with labels giving information as regards the contents. In the case of radiopharmaceuticals it is necessary to indicate on the label, in addition to the name of the composition, the batch number and possible administration date, also the quantity of radioactivity and the reference indicators in connection with the decay of the radioactivity. All these data are necessary to enable checks to be made at the manufacturers and to inform the user of the contents.

Recently, over the past few years, it has been necessary for an increasing amount of data to be recorded on the label; for example, the registration authorities in various countries demand as a matter of course more and more information as regards the contents of the vials or ampoules, preferably in the language of the country in question. Statement of these data on one of the outer packages, such as on the cardboard, on the tinplate or on the lead pot is not satisfactory, because, although the ultimate use still requires knowledge of this data, in practice the outer packages are separated from the vial or ampoule containing the pharmaceutical composition.

Furthermore, enlarging the label on the vial or ampoule does not provide a solution to this problem, particularly in the case of the small vials or ampoules which are commonly used for radiopharmaceutical compositions. The dimensions of the label must in addition be restricted so that any visual check of the contents of vial or ampoule remains possible. Also, the label on the vial or ampoule must be opaque since variable data are provided by typewriter.

In addition, an important disadvantage of stating more data on the small vial or ampoule is that the reader of the small label is exposed to radioactive radiation for a longer time since the small print impedes reading and the longer text requires more time.

The present invention seeks to mitigate the aforesaid disadvantages, particularly by placing the vial or ampoule in a transparent holder. According to the present invention there is provided a package for radiopharmaceutical compositions said package comprising a labeled glass vial or ampoule around which a transparent holder is secured, if desired detachably, to the vial or ampoule. When picking up either the vial or ampoule, or the holder, however, both remain secured or connected together such that the label with the variable data on the vial or ampoule can be read through the transparent wall of the holder. In addition, the contents of the vial or ampoule can simultaneously be checked visually.

It is a particular aspect of the invention that the transparent holder which has a larger circumference can also be provided with a corresponding and preferred larger label. The label on the vial or ampoule may then be kept small, so that it only comprises the most necessary data, such as the name of the composition, batch number and date. For additional data, in particular for data required by the various authorities, sufficient space is available on the label on the holder. The small label on the vial or ampoule permits better visual inspection of the contents.

An additional advantage of the holder is that, if, upon dispensing, the outside of the vial or ampoule has been contaminated with radiactivity, such contamination cannot be transferred to the lead pot or to protective gloves or other auxiliary tools (e.g., tweezers) used by handler. Such pots, gloves and auxiliary tools are generally reused.

In one embodiment the holder is also provided with a label; in that case the user can proceed as follows:

The vial or ampoule together with the holder provided around it is taken out of the lead pot and superficially checked visually. The label on the holder can easily be read due to the larger type on the label. The variable data on the vial or ampoule can also be read clearly through the transparent wall of the holder.

In the case when the holder is detachably connected around the vial or ampoule, the vial or ampoule may be detached from the holder, if desired, and be placed back in the lead pot whilst the label on the holder is read very carefully with the minimal risk of danger from exposure to radioactive radiation.

When the reader/user is sufficiently informed of the contents of the vial or ampoule, it may be opened and the radiopharmaceutical composition may be used. The vial or ampoule with the holder is then placed back in the lead pot.

By also manufacturing the label on the holder made of transparent material, the visual inspection of the contents of the vial or ampoule in the holder is facilitated. In addition, the label on the vial or ampoule remains more easily readable. The holder may be in the form of a beaker made of glass or non-deformable plastic. The holder comprises holding means for the vial or ampoule; these holding means are preferably situated on the open upper side of the holder.

The combined labelling technique described above permits inspection of the contents of vial or ampoule, while the legal requirements as regards the prescribed information are also satisfied. In practice, the holding means may be provided on the upper side of the holder to ensure that holder and vial or ampoule during normal use are not separated.

The invention will now be described in greater detail with reference to an embodiment which is shown in the drawing.

BRIEF FIGURE DESCRIPTION

FIG. 1 is a longitudinal sectional view of a holder and vial comprising a package according to the invention, while FIG. 2 is a plan view of the same holder but without the vial.

The holder (1) shown in FIGS. 1 and 2 is in the form of a beaker and has on its upper side three resilient lugs or tags (2) which are directed inwardly and enclose an angle $\alpha$ with the wall of the holder.

The holder is suitable for holding a substantially cylindrical vial or ampoule (3), as shown in FIG. 1. The outside diameter of the vial is equal to or slightly smaller than the smallest inside diameter d of the holder. The walls of the holder are slightly tapered outwardly such that the inside diameter of the holder ($d^1$) at the lugs is larger than the inside diameter d at the bottom of the holder. The vial or ampoule is provided on its upper side with a neck in which or on which a closure for the vial is provided. The outside height of the vial or ampoule measured from the lower side to the transition of the neck is slightly smaller than the inner height h of the holder. The transparent holder shown in FIG. 1 has a label (4). The vial or ampoule shown in FIG. 1 also has a label (5).

When packaging the ampoule or vial, it is pushed into the holder without much effort from above, the resilient lugs or tags slightly bending outwards radially. By pushing the vial or ampoule downwards as much as possible, the lugs or tags can return to their original position due to their own resilience and thus enclose the neck of the vial or ampoule; the vial or ampoule and the holder are now secured together. When the vial or ampoule is lifted by its neck, the vial or ampoule and holder remain connected together. If desired, this connection can be removed without much effort by pulling the vial or ampoule out of the holder against the resilience of the lugs or tags.

What is claimed is:

1. A package for radiopharmaceutical compositions, which package comprises a transparent holder having a closed bottom and an open top and a labelled vial received in said holder, said holder including holding means for engaging said vial.

2. A package in accordance with claim 1 wherein the holder is detachably secured to the vial.

3. The package of claim 2 wherein the distance between opposite sides of said holder increases in the direction of said open top of said holder, and the minimum inside diameter of said holder is equal to or slightly larger than the outside diameter of said vial.

4. A package in accordance with claim 1 wherein the holder has a transparent label.

5. A package in accordance with claim 1 wherein said holding means is situated at the perimeter of the holder, near said open top.

6. A package in accordance with claim 5 wherein the holder is of non-deformable plastic and the holding means situated thereon comprises at least three inwardly directed resilient lugs which form one assembly with said holder, the free ends of which lugs are directed upwards obliquely.

7. A holder as recited in claims 5 or 6.

8. A package for radiopharmaceutical compositions, said package comprising a vial containing a radiopharmaceutical composition and a holder with an open top for said vial, said vial having an information-carrying label covering at least a part of its surface, said holder having a visually transparent wall section through which the information of said vial label can be read, said holder including means for detachably securing said vial within said holder, said means being situated at said open top, said holder further including a transparent information-carrying label larger than that associated with said vial.

9. The package of claim 8 wherein the distance between opposite sides of said holder increases in the direction of said open top of said holder, and the minimum inside diameter of said holder is equal to or slightly larger than the outside diameter of said vial.

* * * * *